US006796775B2

(12) United States Patent
Mori

(10) Patent No.: US 6,796,775 B2
(45) Date of Patent: Sep. 28, 2004

(54) FUEL INJECTION PUMP

(75) Inventor: Katsumi Mori, Chiryu (JP)

(73) Assignee: Denso Corporation (JP)

( * ) Notice: Subject to any disclaimer, the term of this patent is extended or adjusted under 35 U.S.C. 154(b) by 42 days.

(21) Appl. No.: 10/173,119

(22) Filed: Jun. 18, 2002

(65) Prior Publication Data

US 2002/0192092 A1 Dec. 19, 2002

(30) Foreign Application Priority Data

Jun. 18, 2001 (JP) ..... 2001-183554

(51) Int. Cl.[7] ..... F02M 55/02
(52) U.S. Cl. ..... 417/273; 123/447; 123/469
(58) Field of Search ..... 123/447, 468, 123/469; 417/273, 470, 540, 570

(56) References Cited

U.S. PATENT DOCUMENTS 2,393,175 A * 1/1946 Laskey ..... 417/273
2,414,518 A * 1/1947 Garday ..... 417/273
6,224,351 B1 * 5/2001 Simon et al. ..... 417/273
6,238,189 B1 * 5/2001 Guentert ..... 417/273
6,289,875 B1 9/2001 Shinohara et al.

FOREIGN PATENT DOCUMENTS

JP 10-2130423 8/1998
JP 2000-240531 9/2000

* cited by examiner

*Primary Examiner*—Michael Koczo
(74) *Attorney, Agent, or Firm*—Nixon & Vanderhye PC

(57) ABSTRACT

A fuel injection pump has a drive shaft. A cam rotates together with the drive shaft. A plurality of plungers, slidably supported by a pump housing and driven by the cam, reciprocate in accordance with rotation of the cam to pressurize the fuel introduced in a fuel pressurizing chamber. The pressurized fuel is fed to an accumulator via a fuel feed passage formed in the pump housing. A pipe joint portion is integrally formed with the pump housing and is directly connected to a piping member of the accumulator.

12 Claims, 5 Drawing Sheets

FUEL INJECTION PUMP

BACKGROUND OF THE INVENTION

The present invention relates to a fuel injection pump associated with an internal combustion engine.

One of conventionally known fuel injection pumps is a so-called star type fuel injection pump which has a plurality of plungers disposed in radial directions with respect to a cam. A fuel pressurizing chamber is formed for each plunger. The plunger causes a pressing movement in response to rotation of the cam for pressurizing the fuel stored in the fuel pressurizing chamber. According to the star-type fuel injection pump, respective fuel pressurizing chambers send out the high-pressure fuel via their fuel feed passages. The fuel feed passages of respective fuel pressurizing chambers merge into a single fuel feed passage. The pressurized fuel is then supplied from the single fuel feed passage to a common rail.

The unexamined Japanese patent publication No. 2000-240531, corresponding to U.S. Pat. No. 6,289,875, discloses the accumulator type fuel injection pump which has a cylinder head for slidably supporting plungers which reciprocate in radial directions with respect to a drive shaft. This conventional fuel injection pump has a pipe joint member which is formed separately from the cylinder head. The pipe joint member is an intermediate joint member which holds or supports a high-pressure check valve attached to the cylinder head. The high-pressure check valve comprises a ball valve member and a spring accommodated therein. One end of the pipe joint member is inserted into a joint port of the cylinder head so as to fixedly holds or supports the check valve. The other end of the pipe joint member is connected to a fuel pipe of the common rail.

Recently, to improve the fuel consumption, downsizing of an engine body is earnestly required. Accordingly, the size of a fuel injection pump must be small. The screw size of a pipe joint member must be small too. This may force the pipe joint member to rotate together with the fuel pipe during a fastening operation of the fuel pipe. The cylinder head will be subjected to an excessive load which possibly causes deformation of the cylinder head and accordingly causes seizure of the plungers. Furthermore, there is the possibility that the pipe joint member may loosen when the pipe joint member rotates together with the fuel pipe. This will result in leakage of oil.

SUMMARY OF THE INVENTION

In view of the above-described problems, the present invention has an object to provide a fuel injection pump which is capable of preventing the pump housing from deforming and also preventing the pump components or members from seizing, thereby improving the reliability of fuel injection pump.

Another object of the present invention is to provide a fuel injection pump which is capable of eliminating the leakage of oil which may be caused when the pipe joint member is loosened.

Furthermore, another object of the present invention is to provide a fuel injection pump which has an optimized arrangement for facilitating the installation of fuel pipes to the pump housing.

In order to accomplish the above and other related objects, the present invention provides a fuel injection pump comprising a drive shaft and a cam rotating together with the drive shaft. A movable member, driven by the cam, reciprocates in accordance with rotation of the cam for pressurizing the fuel introduced in a fuel pressurizing chamber. The pressurized fuel is fed from the fuel pressurizing chamber to an accumulator via a fuel feed passage. A pump housing has the fuel feed passage formed therein. A pipe joint portion is integrally formed with the pump housing and is directly connectable to a piping member of the accumulator.

According to the arrangement of the fuel injection pump of the present invention, the pipe joint portion is integrally formed with the pump housing. Thus, it is possible to surely prevent the pipe joint portion from rotating together with the piping member of the accumulator during a fastening operation of the piping member of the accumulator. Even if the size of the pump housing is reduced, the pipe joint portion does not rotate. This prevents the pump housing from being subjected to an excessive load. Accordingly, it becomes possible to prevent the pump housing from deforming and also prevent the movable member from seizing. Thus, the reliability of fuel injection pump can be improved. Needless to say, no leakage of oil occurs because the pipe joint portion does not loosen.

It is preferable that the pipe joint portion has an external thread portion engageable with the piping member of the accumulator. Alternatively, it is preferable that the pipe joint portion has an internal thread portion engageable with the piping member of the accumulator.

This arrangement makes it easy to install the piping member after finishing the installation of fuel injection pump to the engine body. The time required for installing the piping member can be reduced. This realizes optimized pipe connection which causes no interference between the piping member and peripheral members. The degree of freedom is improved in the mounting of fuel injection pump.

Furthermore, it is preferable that the pump housing has a first opening connected to a piping member communicating with other pump chamber via an intermediate joint member which holds a check valve, and has a second opening directly connected to the piping member of the accumulator.

Moreover, it is preferable that the pump housing supports the movable member so as to allow the movable member to reciprocate in this pump housing.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
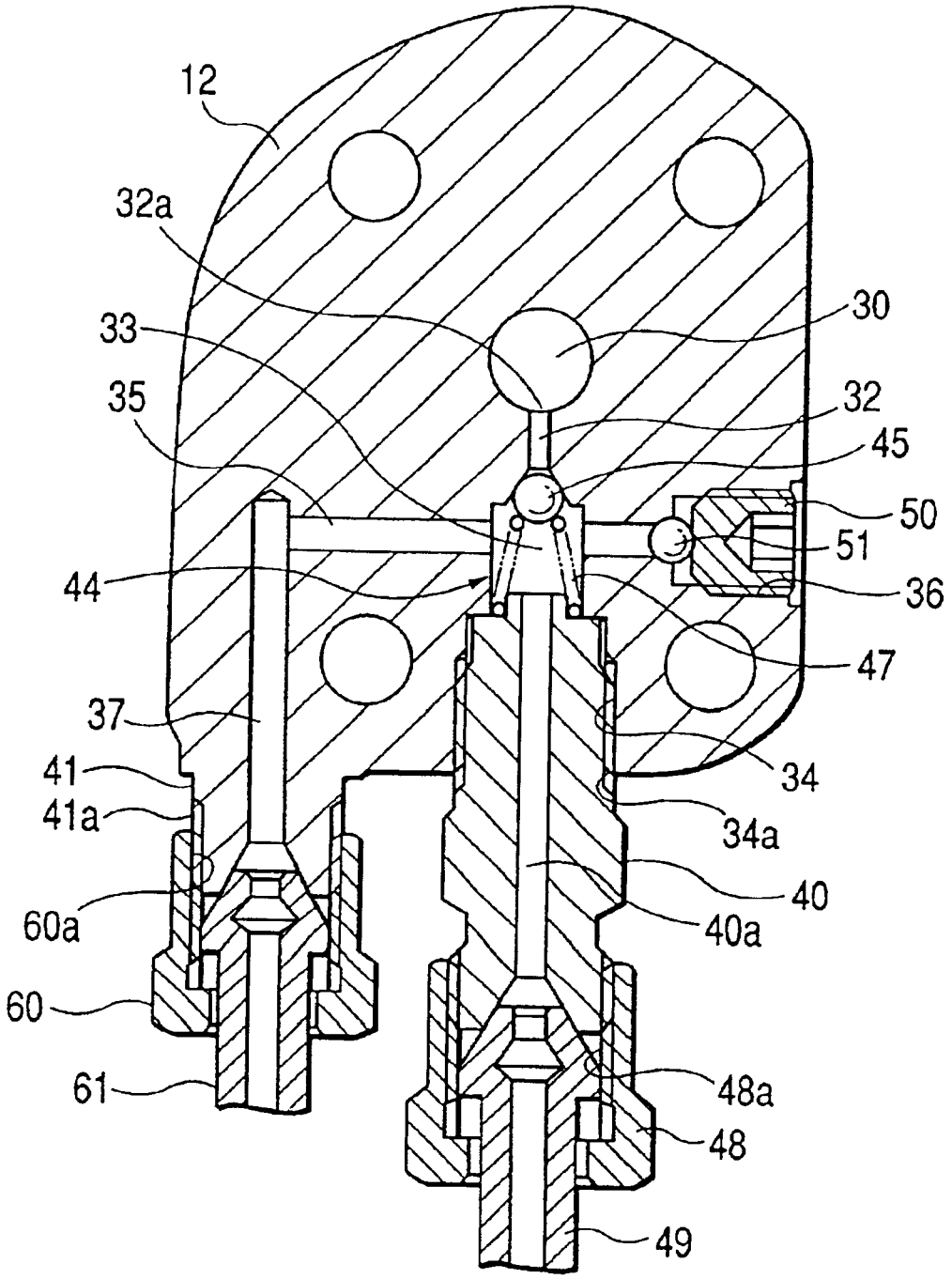
FIG. 1 is a transverse cross-sectional view showing an essential arrangement of a fuel injection pump in accordance with a first embodiment of the present invention, taken along a line I—I of FIG. 2.

Preferred embodiments of the present invention will be explained hereinafter with reference to attached drawings. Identical parts are denoted by the same reference numerals throughout the drawings.

First Embodiment

Hereinafter, a fuel injection pump for a diesel engine in accordance with a first embodiment of the present invention will be explained with reference to FIGS. 1 through 3.

Figure 3:
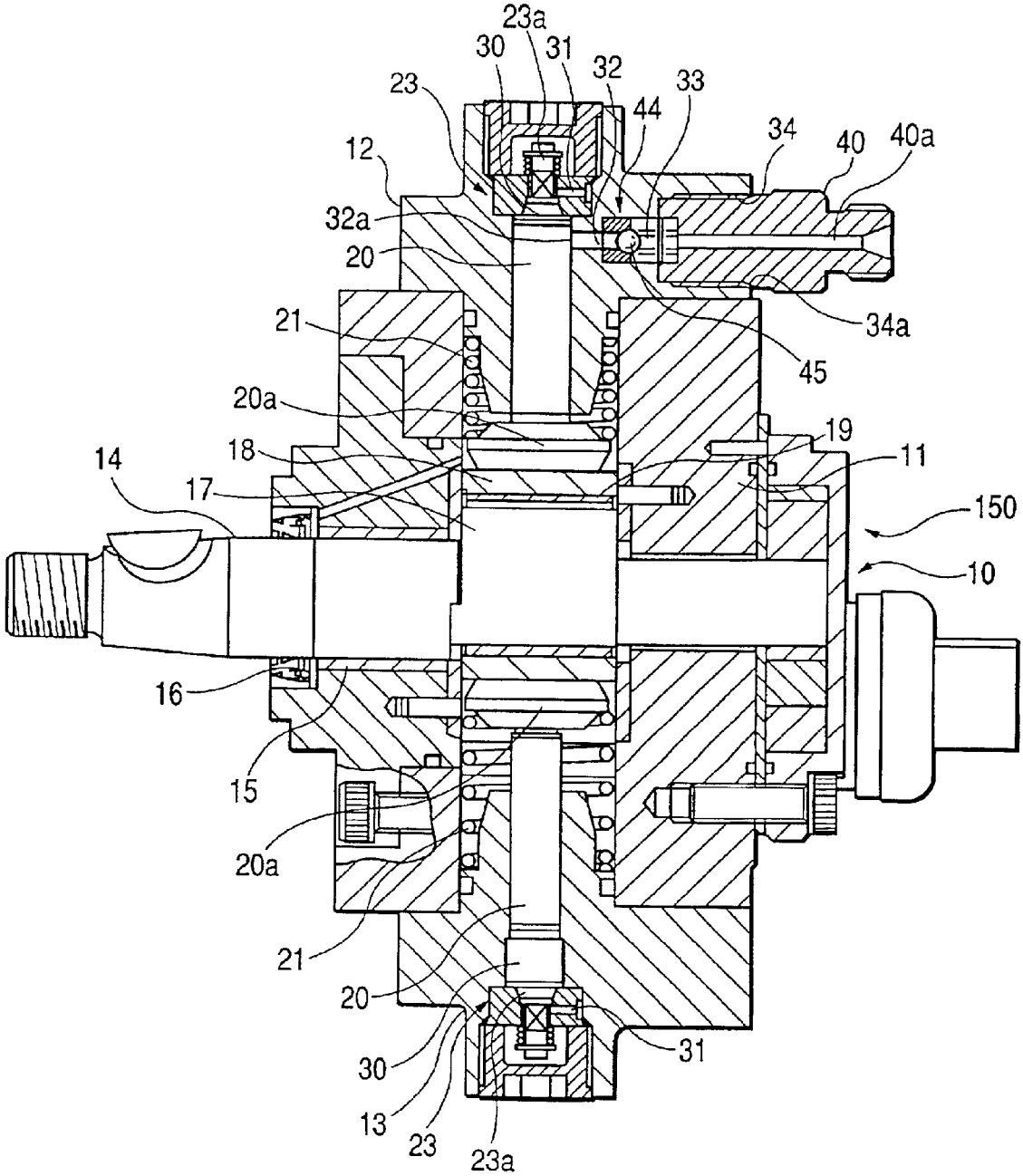
FIG. 3 is a vertical cross-sectional view showing the arrangement of the fuel injection pump in accordance with the first embodiment of the present invention, taken along a line III—III of FIG. 2.

As shown in FIG. 3, a fuel injection pump 10 has a pump housing comprising a housing body 11 and cylinder heads 12 and 13. The housing body 11 is an aluminum product, while the cylinder heads 12 and 13 are iron products. Each of the cylinder heads 12 and 13 supports a plunger 20 which slides as a movable member. The plungers 20 reciprocate in radial holes formed in respective cylinder heads 12 and 13. A fuel pressurizing chamber 30 is defined by an inner wall surface of cylinder head 12 (or 13), an end surface of check valve 23, and an end surface of plunger 20. According to the first embodiment, the cylinder head 12 and the cylinder head 13 are formed into the same configuration except for their screw holes and fuel passages. It is however possible to form the cylinder head 12 and the cylinder head 13 into the same configuration without exception.

A drive shaft 14 is rotatably supported by the housing body 11 via a journal 15. A clearance between the housing body 11 and the drive shaft 14 is sealed by an oil seal 16. A cam 17, having a circular cross section, is integrally formed with the drive shaft 14. The cam 17 is eccentric with respect to the drive shaft 14. Two plungers 20 are symmetrically opposed to each other with respect to the drive shaft 14. A shoe 18 has a rectangular outer configuration in cross section. A bush 19 is slidably interposed between an inner surface of shoe 18 and the cam 17. An outer portion of shoe 18 facing to plunger 20 and an end surface of a plunger head 20*a* are formed into flat surfaces and brought into contact with each other.

The plunger 20 is driven by the cam 17 via the shoe 18 to reciprocate in accordance with rotation of drive shaft 14. The plunger 20 pressurizes the fuel introduced and stored in the fuel pressurizing chamber 30. The fuel enters into the fuel pressurizing chamber 30 via the check valve 23 from a fuel inlet passage 31. The check valve 23 has a valve member 23*a* which prevents the fuel from flowing back to the fuel inlet passage 31 from the fuel pressurizing chamber 30.

A spring 21 resiliently urges the plunger 20 toward the shoe 18. As the contact surfaces of shoe 18 and plunger 20 are formed into flat surfaces, a bearing stress acting between shoe 18 and plunger 20 is small. Furthermore, the shoe 18 causes a revolution about the drive shaft 14 without autorotation (i.e., rotation about its axis) when it slides relative to the cam 17.

As shown in FIG. 1, a fuel outlet passage 32 extends straight in the cylinder head 12. An upstream side of fuel outlet passage 32, serving as communication port 32*a*, opens into the fuel pressurizing chamber 30. A downstream side of fuel outlet passage 32 is connected to a fuel chamber 33. The fuel chamber 33 is formed into an axially elongated bore having a cross-sectional area larger than that of the fuel outlet passage 32. A check valve 44 is disposed in the fuel chamber 33. An accommodation bore 34 is formed at the downstream side of fuel chamber 33. The accommodation bore 34 has a cross-sectional area larger than that of the fuel chamber 33. The accommodation bore 34 is formed in the cylinder head 12. The accommodation bore 34 has an opening, serving as fuel opening 34*a*, which is formed on an outer wall of cylinder head 12.

A pipe joint member (intermediate joint member) 40, used for connecting a fuel pipe 49 to the cylinder head 12, is disposed in the accommodation bore 34. The pipe joint member 40 is threaded into the accommodation bore 34. A fuel passage 40*a* is formed in the pipe joint member 40. The fuel passage 40*a* opens into the fuel chamber 33. The fuel passage 40*a* is aligned in line with the fuel outlet passage 32. The pipe joint member 40 is connected to the fuel pipe 49 by means of a nut 48. The fuel pipe 49 is a piping member communicating with another pump chamber. The pipe joint member 40 functions as a guide for a later-described spring 47 of check valve 44.

A communication passage 35 is formed in the cylinder head 12 and extends in a direction normal to the fuel outlet passage 32 and the fuel chamber 33. The communication passage 35 opens into the fuel chamber 33 at the downstream side of check valve 44. The communication passage 35 further extends beyond the fuel chamber 33 and opens into an accommodation bore 36. The accommodation bore 36 has a cross-sectional area larger than that of the communication passage 35. The accommodation bore 36 is formed in the cylinder head 12. The accommodation bore 36 has an opening which is formed on an outer wall of cylinder head 12. A plug 50 is disposed in the accommodation bore 36. The plug 50 is threaded into the accommodation bore 36. A ball member 51 shuts the communication between the fuel chamber 33 and the accommodation bore 36.

A pipe joint portion 41, integrally formed with the cylinder head 12, protrudes from the cylinder head 12. A fuel passage 37 is formed in the pipe joint portion 41. The fuel passage 37 has one end connected to the communication passage 35. The fuel passage 37 extends in a direction normal to the communication passage 35. The fuel passage 37 has the opposite end opening at a distal end of pipe joint portion 41. The fuel outlet passage 32, the fuel chamber 33, the communication passage 35, and the fuel passage 37 cooperatively constitute a pressurized fuel feed passage. The pipe joint portion 41 has an external thread portion 41*a* formed on an outer surface thereof. The external thread portion 41*a* is engageable with an internal thread portion 60*a* formed in the nut 60.

A fuel pipe 61, serving as piping member of a common rail, can be directly connected to the pipe joint portion 41 by fastening the nut 60. The common rail serves as accumulator. Accordingly, a pressurized fuel supplied from the fuel injection pump 10 is fed into the common rail via the pipe joint portion 41.

As shown in FIG. 1, the pipe joint portion 41 is disposed in parallel with the pipe joint member 40. The lower end (i.e., distal end) of pipe joint portion 41 is offset in the up-and-down direction with respect to the lower end (i.e., distal end) of pipe joint member 40. This assures optimum pipe connection because no interference is caused in each of installation of fuel pipe 61 to the pipe joint portion 41 and installation of fuel pipe 49 to the pipe joint member 40. The fuel pipe 49 is installed at the time the fuel injection pump 10 is installed, while the fuel pipe 61 is separately installed after finishing the installation of fuel injection pump 10 to the engine body.

The check valve 44, disposed at the downstream side of fuel outlet passage 32, comprises a ball valve member 45 and the spring 47. The spring 47 resiliently urges the ball valve member 45 to shut the fuel outlet passage 32. The check valve 44 prevents the fuel from flowing back to the fuel pressurizing chamber 30 from the fuel chamber 33 via the fuel outlet passage 32.

As shown in FIG. 3, the other cylinder head 13 is disposed at the lower side of housing body 11. The cylinder head 13 is similar to the cylinder head 12 in that a pressurized fuel feed passage (not shown) is provided. A check valve (not shown) is also provided in the cylinder head 13 at the downstream side of the pressurized fuel feed passage. This check valve is connected to the fuel chamber 33 via a pipe joint member 42 shown in FIG. 2. The pipe joint member 42 is connected to the fuel pipe 49 by means of a nut 48. The pipe joint member 40 is thus connected to the pipe joint member 42 via the fuel pipe 49.

Figure 2:
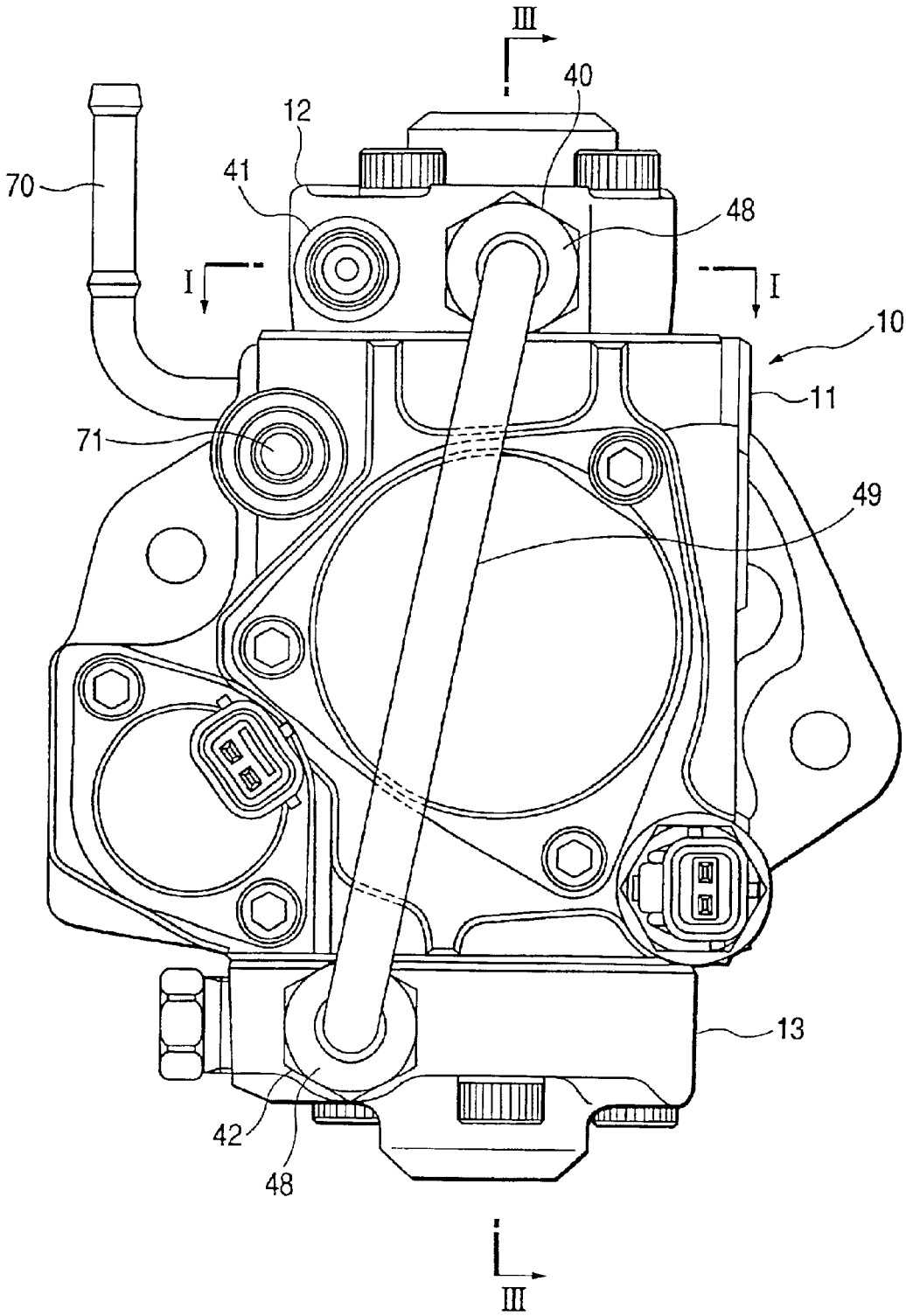
FIG. 2 is a front view showing the fuel injection pump in accordance with the first embodiment of the present invention.

An inner-gear type feed pump 150 shown in FIG. 3 receives the fuel supplied from a fuel tank (not shown) via a fuel inlet 70 shown in FIG. 2. The feed pump 150 pressurizes the introduced fuel and sends the pressurized fuel into a fuel passage 71. When the fuel pressure in the feed pump 150 exceeds a predetermined level, a regulator valve (not shown) opens to return excessive fuel back to the fuel tank.

Furthermore, the housing body 11 is equipped with an electromagnetic valve (not shown) which adjusts a fuel amount introduced into the fuel pressurizing chamber 30 via the fuel inlet passage 31 and the check valve 23 in accordance with engine operating conditions.

The above-described fuel injection pump 10 operates in the following manner.

The cam 17 rotates in accordance with rotation of drive shaft 14. The shoe 18 causes a revolution in accordance with rotation of cam 17, although the shoe 18 does not rotate about its axis. Due to revolution of shoe 18, the flat surfaces of shoe 18 and plunger 20 slidably contact with each other. The plunger 20 reciprocates.

When the plunger 20 lowers from its top dead center according to the revolution of shoe 18, the electromagnetic valve controls the fuel amount sent out from the feed pump 150. The controlled fuel flows into the fuel pressurizing chamber 30 via the check valve 23 from the fuel inlet passage 31. After having reached the bottom dead center, the plunger 20 rises upward toward the top dead center. The check valve 23 closes. The fuel pressure in the fuel pressurizing chamber 30 increases. When the fuel pressure in the fuel pressurizing chamber 30 exceeds the fuel pressure in the fuel chamber 33, the check valve 44 opens.

In the cylinder head 12, the pressurized fuel of fuel pressurizing chamber 30 is sent out via the fuel outlet passage 32, the check valve 44, the fuel chamber 33 to the fuel passages 35 and 37. On the other hand, the pressurized fuel of fuel pressurizing chamber 30 of cylinder head 13 flows into the fuel chamber 33 via the fuel pipe 49 and merges with the pressurized fuel sent out from the fuel pressurizing chamber 30 of cylinder head 12. The pressurized fuel of fuel chamber 33 is then supplied to the common rail via the fuel passage 37 and the fuel pipe 61. The common rail, serving as accumulator, stores the pressurized fuel supplied from the fuel injection pump 10 and suppresses the fluctuation of fuel pressure. The fuel pressure is held at a predetermined constant high-pressure level in the common rail. The high-pressure fuel is then fed into an injector (not shown) from the common rail.

According to the above-described first embodiment, the pipe joint portion 41 is integrally formed with the cylinder head 12. The fuel pipe 61 of the common rail (i.e., the piping member of the accumulator) is directly connected to the pipe joint portion 41. Even if the size of cylinder head 12 is reduced, the pipe joint portion 41 does not rotate together with the nut 60 when the fuel pipe 61 is fastened by the nut 60. This prevents the cylinder head 12 from being subjected to an excessive load. Accordingly, it becomes possible to prevent the cylinder head 12 from deforming and also prevent the plunger 20 from seizing. This improves the reliability of fuel injection pump. Needless to say, as the pipe joint portion 41 does not rotate together with the nut 60, no leakage of fuel occurs.

Furthermore, the pipe joint portion 41 has the external thread portion 41*a* which is engageable with the nut 60 of fuel pipe 61. This makes it easy to install the fuel pipe 61 to the pipe joint portion 41 after finishing the installation of fuel injection pump 10 to the engine body. The time required for installing the fuel pipe 61 can be reduced. This realizes optimized pipe connection which causes no interference between the fuel pie 61 and peripheral members. The degree of freedom is improved in the mounting of fuel injection pump 10.

Second Embodiment

Figure 4:
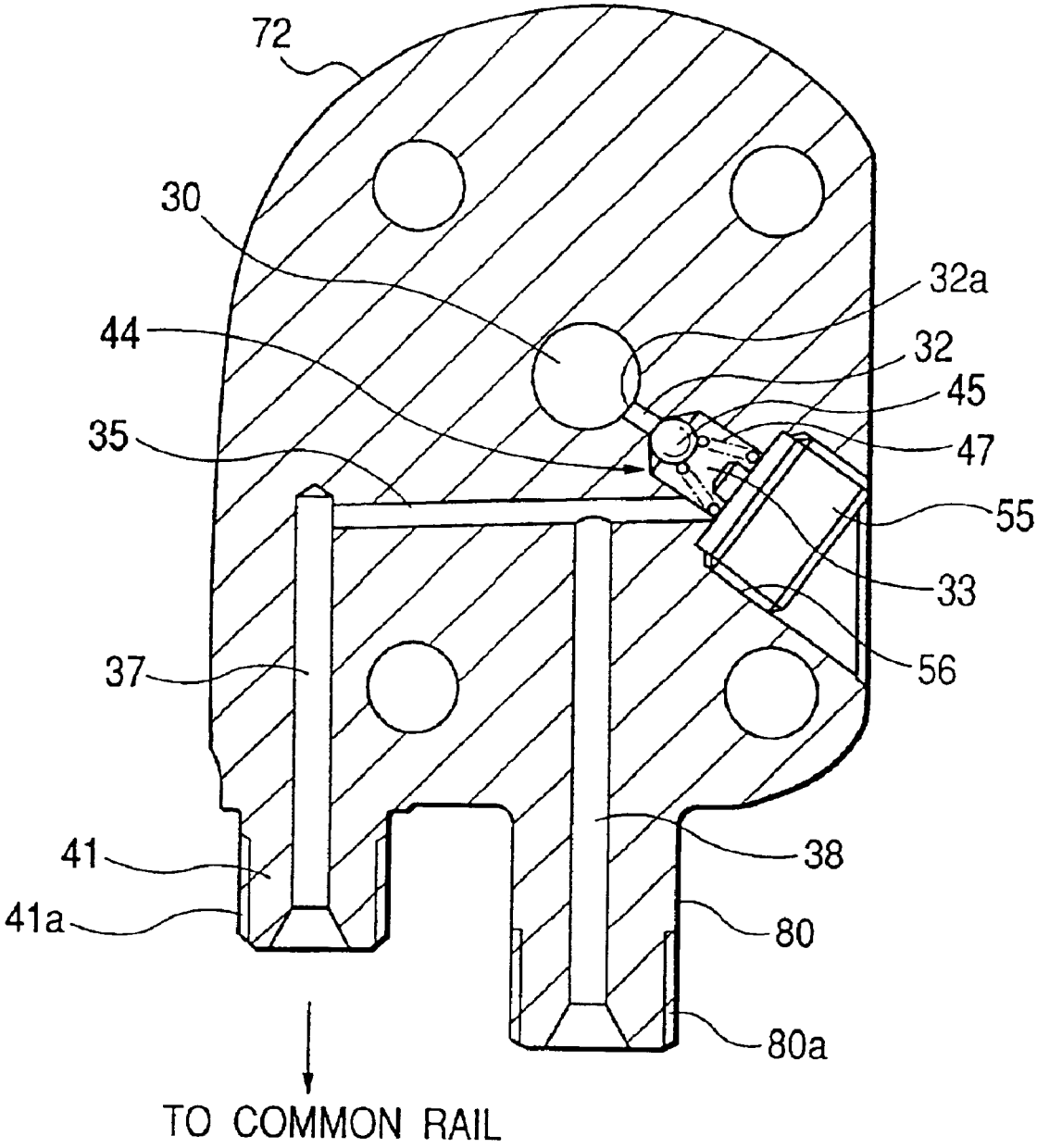
FIG. 4 is a transverse cross-sectional view showing an essential arrangement of a fuel injection pump in accordance with a second embodiment of the present invention, corresponding to FIG. 1.

FIG. 4 shows a second embodiment of the present invention. The components or members identical with those disclosed in the first embodiment are denoted by the same reference numbers.

According to the second embodiment, as shown in FIG. 4, an accommodation bore 56 is formed at the downstream side of the fuel chamber 33 formed in a cylinder head 72. The accommodation bore 56 has a cross-sectional area larger than that of fuel chamber 33. The accommodation bore 56 opens to the outside of cylinder head 72. A plug 55 is disposed in the accommodation bore 56 and fixed by means of a screw or the like. The plug 55 functions as a guide for the spring 47 of check valve 44. A pipe joint portion 80 is parallel to the pipe joint portion 41. The pipe joint portion (intermediate joint member) 80 is integrally formed with the cylinder head 72 and protrudes from the cylinder head 72. A fuel passage 38 is formed in the pipe joint portion 80. The fuel passage 38 is connected to the communication passage 35. The fuel passage 38 extends in a direction normal to the communication passage 35. The fuel passage 38 opens to the distal end of pipe joint portion 80. The pipe joint portion 80 has an external thread portion 80*a* formed on an outer surface thereof. The external thread portion 80*a* is engageable with an internal thread portion 48*a* formed in the nut 48 shown in FIG. 1. The fuel pipe 49 can be directly connected to the pipe joint portion 80 by fastening the nut 48.

As shown in FIG. 4, the pipe joint portion 80 is disposed in parallel with the pipe joint portion 41. The lower end (i.e., distal end) of pipe joint portion 80 is offset in the up-and-down direction with respect to the lower end (i.e., distal end) of pipe joint portion 41. This assures optimum pipe connection because no interference is caused in each of installation of fuel pipe 61 to the pipe joint portion 41 and installation of fuel pipe 49 to the pipe joint portion 80.

The second embodiment brings the same effects as those of the first embodiment. Furthermore, according to the second embodiment, the installation of fuel pipe 49 to the pipe joint portion 80 can be easily accomplished.

Third Embodiment

Figure 5:
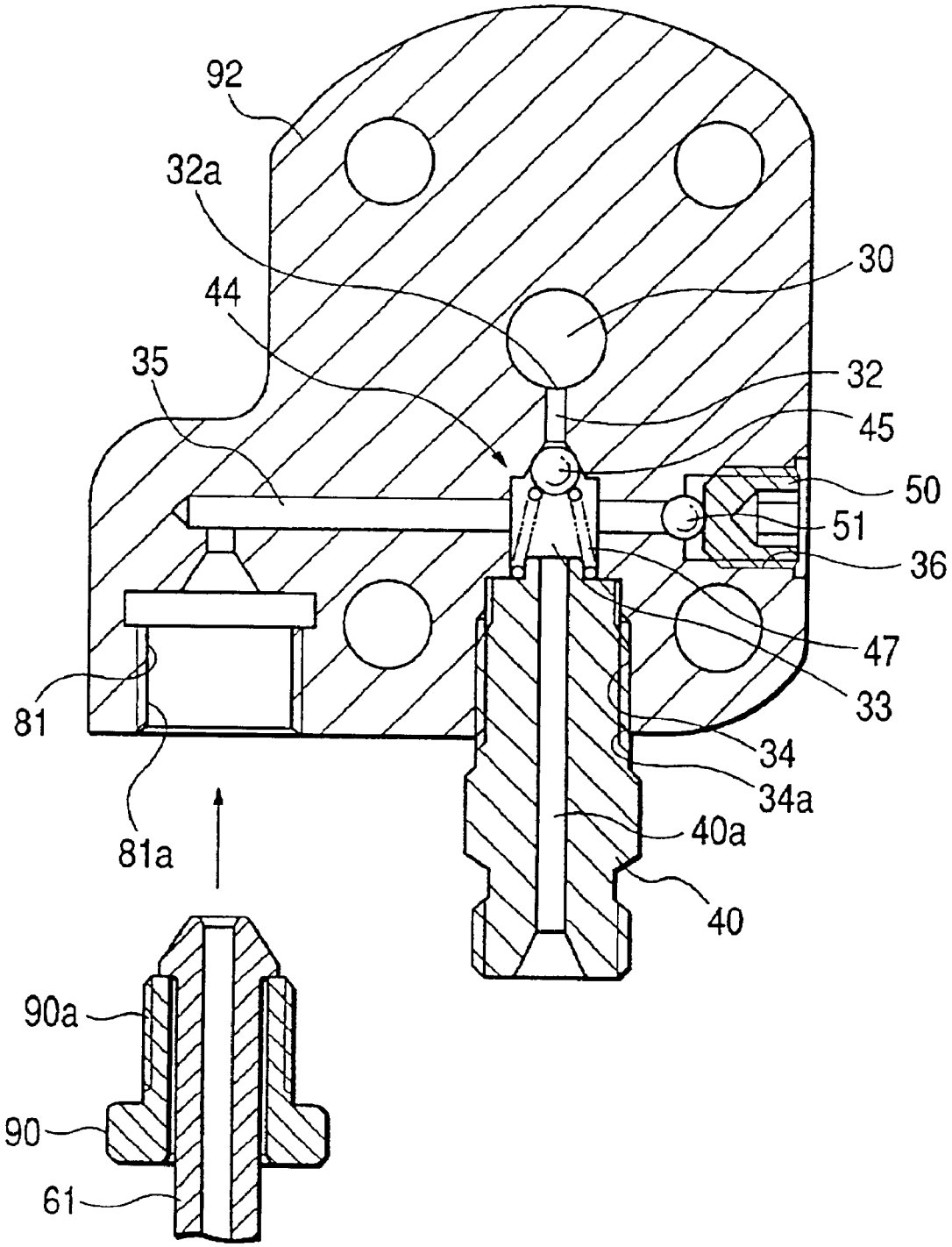
FIG. 5 is a transverse cross-sectional view showing an essential arrangement of a fuel injection pump in accordance with a third embodiment of the present invention, corresponding to FIG. 1.

FIG. 5 shows a third embodiment of the present invention. The components or members identical with those disclosed in the first embodiment are denoted by the same reference numbers.

According to the third embodiment, as shown in FIG. 5, a pipe joint portion (connecting bore) 81 is formed at the downstream side of the communication passage 35 formed in a cylinder head 92. The pipe joint portion 81 has a cross-sectional area larger than that of the communication passage 35. The pipe joint portion 81 opens to the outside of the cylinder head 92. An internal thread portion 81*a* is formed on an inner wall of the pipe joint portion 81. An external thread portion 90*a* of a nut 90, serving as connecting portion, is engageable with the internal thread portion 81*a* of pipe joint portion 81. The fuel pipe 61 can be directly connected to the pipe joint portion 81 by fastening the nut 90. The high-pressure fuel pressurized by the fuel injection pump is supplied to the common rail from the pipe joint portion 81.

The third embodiment brings the same effects as those of the first embodiment. Furthermore, according to the third embodiment, the pipe joint portion 81 has the internal thread portion 81*a* and no protruding portion provided for the pipe connection. This is effective to eliminate any interference during the installation of fuel pipe 61 and to realize optimized pipe connection.

According to the above-described embodiments, the present invention is applied to the fuel injection pump which has a cylinder head 12 (72, 92) formed separately from the housing body. However, it is possible to integrally form the cylinder head with the housing body and integrally form the pipe joint portion with this pump housing.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A fuel injection pump comprising:

a drive shaft;

a cam rotating together with said drive shaft;

a movable member driven by said cam and reciprocating in accordance with rotation of said cam for pressurizing fuel introduced in a fuel pressurizing chamber, the pressurized fuel being fed from the fuel pressurizing chamber to an accumulator via a fuel feed passage;

a pump housing having said fuel feed passage formed therein; and a pipe joint portion which is integrally formed as part of and in one piece with said pump housing and directly connects a passage of a piping member of said accumulator to said fuel feed passage.

2. The fuel injection pump in accordance with claim 1, wherein said pipe joint portion has an external thread portion engageable with said piping member of said accumulator.

3. The fuel injection pump in accordance with claim 1, wherein said pipe joint portion has an internal thread portion engageable with said piping member of said accumulator.

4. The fuel injection pump in accordance with claim 1, wherein said pump housing has a first opening connected to a piping member communicating with another pump chamber via an intermediate joint member which holds a check valve, and has a second opening directly connected to said piping member of said accumulator.

5. The fuel injection pump in accordance with claim 4, wherein said intermediate joint member has an external thread portion formed on an outer surface thereof, engageable with said piping member communicating with said another pump chamber.

6. The fuel injection pump in accordance with claim 4, wherein said pipe joint portion is disposed in parallel with said intermediate joint member.

7. The fuel injection pump in accordance with claim 6, wherein a lower end of said pipe joint portion is offset in a vertical direction with respect to a lower end of the intermediate joint member.

8. The fuel injection pump in accordance with claim 1, wherein said pump housing supports said movable member so as to allow said movable member to reciprocate in said housing.

9. The fuel injection pump in accordance with claim 1, wherein said pump housing has a first opening connected to a piping member communicating with another pump chamber via an intermediate joint member, and has a second opening directly connected to said piping member of said accumulator, said intermediate joint member being integrally formed as a part of and in one piece with said pump housing and directly connecting a passage of said piping member communicating with said another pump chamber to said fuel feed passage.

10. The fuel injection pump in accordance with claim 9, wherein said intermediate joint member has an external thread portion formed on an outer surface thereof, engageable with said piping member communicating with said another pump chamber.

11. The fuel injection pump in accordance with claim 9, wherein said pipe joint portion is disposed in parallel with said intermediate joint member.

12. The fuel injection pump in accordance with claim 11, wherein a lower end of said pipe joint portion is offset in a vertical direction with respect to a lower end of the intermediate joint member.

* * * * *